US005133329A

United States Patent [19]

Rodseth et al.

[11] Patent Number: 5,133,329

[45] Date of Patent: Jul. 28, 1992

[54] IGNITION SYSTEM FOR COMBUSTION-POWERED TOOL

[75] Inventors: William G. Rodseth, Elgin; Ernest J. Wendling, Algonquin, both of Ill.

[73] Assignee: Illinois Tool Works Inc., Glenview, Ill.

[21] Appl. No.: 797,355

[22] Filed: Nov. 25, 1991

[51] Int. Cl.[5] ..... F02P 11/00

[52] U.S. Cl. ..... 123/630; 123/46 SC; 123/597; 123/598; 123/613; 123/615

[58] Field of Search ..... 123/630, 597, 46 SC, 123/594, 613, 615, 179 BG; 60/632, 633; 227/8

[56] References Cited

U.S. PATENT DOCUMENTS

| | | | |
|---|---|---|---|
| 4,483,473 | 11/1984 | Wagdy | 227/8 |
| 4,483,474 | 11/1984 | Nikolich | 227/8 |
| 4,522,162 | 6/1985 | Nickolich | 123/46 C |
| 4,930,466 | 1/1990 | Osborne, Jr. | 123/630 |
| 4,949,684 | 8/1990 | Gabiara | 123/630 |
| 4,986,228 | 1/1991 | Tharman | 123/179 BG |
| 5,076,250 | 12/1991 | Sasaki et al. | 123/630 |
| 5,101,802 | 4/1992 | Reinhard | 123/630 |

*Primary Examiner*—Raymond A. Neill

*Attorney, Agent, or Firm*—Neal C. Johnson; Thomas W. Buckman; John P. O'Brien

[57] ABSTRACT

For a combustion-powered tool, an ignition system is powered by a battery and is arranged so that a sudden discharge of a capacitor, as charged via an oscillator, produces a spark at a spark gap of a spark plug, so that the oscillator is enabled if a trigger switch is closed while a head switch is closed, but not if the trigger switch is closed while the head switch is opened, and if a battery voltage, as monitored, is not less than a reference voltage, and so that a silicon-controlled rectifier, which is arranged to produce a sudden discharge of the capacitor, is switched to a conductive state if the capacitor voltage, as monitored, and is not less than a reference voltage. The head and trigger switches, which are photoelectric, are polled intermittently to determine whether they are closed. Predominantly, solid-state components are used.

14 Claims, 2 Drawing Sheets

IGNITION SYSTEM FOR COMBUSTION-POWERED TOOL

TECHNICAL FIELD OF THE INVENTION

This invention pertains to an ignition system for a combustion-powered tool, such as a combustion-powered, fastener-driving tool, which system comprises a head switch and a trigger switch. The ignition system is arranged so that ignition is enabled if the trigger switch is closed while the head switch is closed but not if the trigger switch is closed while the head switch is opened. The ignition system may be also arranged so that ignition is enabled if a battery voltage is not less than a reference voltage, and if a capacitor voltage is not less than a reference voltage, but not otherwise.

BACKGROUND OF THE INVENTION

Combustion-powered, fastener-driving tools, such as combustion-powered, nail-driving tools and combustion-powered, staple-driving tools, are exemplified in Nikolich U.S. Pat. No. Re. 32,452, Nikolich U.S. Pat. Nos. 4,522,162, and 4,483,474, Wagdy 4,483,473, and Nikolich 4,403,722.

Typically, such a tool comprises several normally opened switches connected to a battery, namely an on-off switch, a head switch, and a trigger switch, all of which must be closed to enable ignition of a combustible fuel in a combustion chamber of the tool. The on-off switch is closed by the user pressing a lever, which is mounted operatively to a handle of the tool, with the palm of one hand and is used to control a fan. The head switch is closed by pressing a workpiece-contacting element, which is mounted operatively to a nosepiece of the tool, firmly against a workpiece. The trigger switch is closed by pulling a trigger, which is mounted operatively to the handle, with the index finger of the same hand. Typically, in such a tool, the head and trigger switches are interlocked mechanically in such manner that the trigger switch cannot be closed unless the head switch is closed.

Heretofore, in the ignition system of such a tool, it has been known to use a battery for powering the ignition system, to use a charge-pump oscillator to charge a capacitor over a timed interval, and to cause a sudden discharge of the capacitor through the primary winding of a transformer, when the timed interval ends, so as to produce a spark at the spark gap of a spark plug connected to the secondary winding of the transformer. Although such a system has proved to be quite satisfactory, some variations can occur from one operation of the tool to another, particularly if the battery voltage drops below a minimum voltage needed for proper ignition when the fan is enabled or if the capacitor is not charged to a minimum voltage needed for proper ignition over the timed interval. Even if the tool continues to operate satisfactorily, a user may be nonetheless able to perceive such variations, which are reflected directly in combustion efficiency and indirectly in perceived recoil of the tool. Any significant variations in perceived recoil of the tool can be distracting to a user.

Recently, photoelectric switches that can be advantageously used as the head and trigger switches of such a tool have become available, as disclosed in a copending patent application assigned commonly herewith and filed Jun. 17, 1991, under U.S. Ser. No. 07/716,215, for PHOTOELECTRIC SWITCH SEALED AGAINST INFILTRATION OF CONTAMINANTS. Thus, a need has arisen for an ignition system in a combustion-powered tool, such as a combustion-powered nail-driving tool or a combustion-powered, staple-driving tool, enabling such photoelectric switches to be effectively used as the head and trigger switches. This invention is addressed to the need that has arisen.

SUMMARY OF THE INVENTION

This invention provides an ignition system embodying significant improvements for a combustion-powered tool, such as a combustion-powered nail-driving tool or a combustion-powered, staple-driving tool. The ignition system enables photoelectric switches, such as photoelectric switches according to the copending application noted above, to be effectively used as the head and trigger switches of the tool. The ignition system may be advantageously embodied so as to minimize the distracting variations discussed above.

Broadly, the ignition system provided by this invention comprises a battery, two normally opened, switches connected to the battery, namely a head switch and a trigger switch, a circuit powered by the battery for producing ignition, and a switch-monitoring circuit for monitoring the head and trigger switches, for enabling the ignition-producing circuit if the trigger switch is closed while the head switch is closed, and for disabling the ignition-producing circuit if the trigger switch is closed while the head switch is opened or if both switches are opened. It is convenient to refer to the battery, the head switch, and the trigger switch as components of the ignition system.

According to a first aspect of this invention, it is preferred that the ignition-producing circuit comprises a spark plug having a spark gap, means comprising a capacitor for producing a spark across the spark gap upon a sudden discharge of the capacitor, a circuit powered by the battery for charging the capacitor, a circuit for producing a sudden discharge of the capacitor, and a battery-monitoring circuit for monitoring the battery voltage, for comparing the battery voltage to a reference voltage for the battery, for enabling the capacitor-charging circuit if the battery voltage monitored thereby is not less than the reference voltage for the battery, and for disabling the capacitor-charging circuit if the battery voltage monitored thereby is less than the reference voltage for the battery.

Preferably, the ignition system comprises a fan powered by the battery and with a circuit for enabling the fan if the head switch is closed, the battery-monitoring circuit being arranged to monitor the battery voltage when the fan is enabled. Preferably, moreover, the same circuit is arranged to disable the fan after a time delay (e.g. ten seconds) upon opening of the head switch. Thus, the fan remains operative to purge combustion products from the tool after each operation, even if there is little time between such operation and the next operation.

According to a second aspect of this invention, it is preferred that the ignition producing circuit comprises a capacitor-monitoring circuit, which is used to monitor the capacitor provided for providing a spark upon its sudden discharge. The capacitor-monitoring circuit is provided for monitoring the capacitor voltage, for comparing the capacitor voltage to a reference voltage for the capacitor, for enabling the circuit for producing a sudden discharge of the capacitor if the capacitor voltage is not less than the reference voltage for the capacitor, and for disabling the capacitor-charging circuit if the capacitor voltage monitored thereby is less than the reference voltage for the capacitor.

According to a third aspect of this invention, it is preferred that the switch-monitoring circuit comprises a circuit for monitoring the head switch intermittently to determine whether the head switch is closed and a circuit for monitoring the trigger switch intermittently to determine whether the trigger switch is closed. Battery energy may be thus conserved.

The switch-monitoring, battery-monitoring, and capacitor-monitoring circuits discussed above may be advantageously combined in a preferred embodiment of the ignition system provided by this invention, not only to enable photoelectric switches to be effectively used as the head and trigger switches but also to minimize the distracting variations discussed above.

These and other objects, features, and advantages of this invention are evident from the following description of a preferred embodiment of this invention with reference to the accompanying drawings.

DETAILED DESCRIPTION OF PREFERRED EMBODIMENT

Figure 1A:
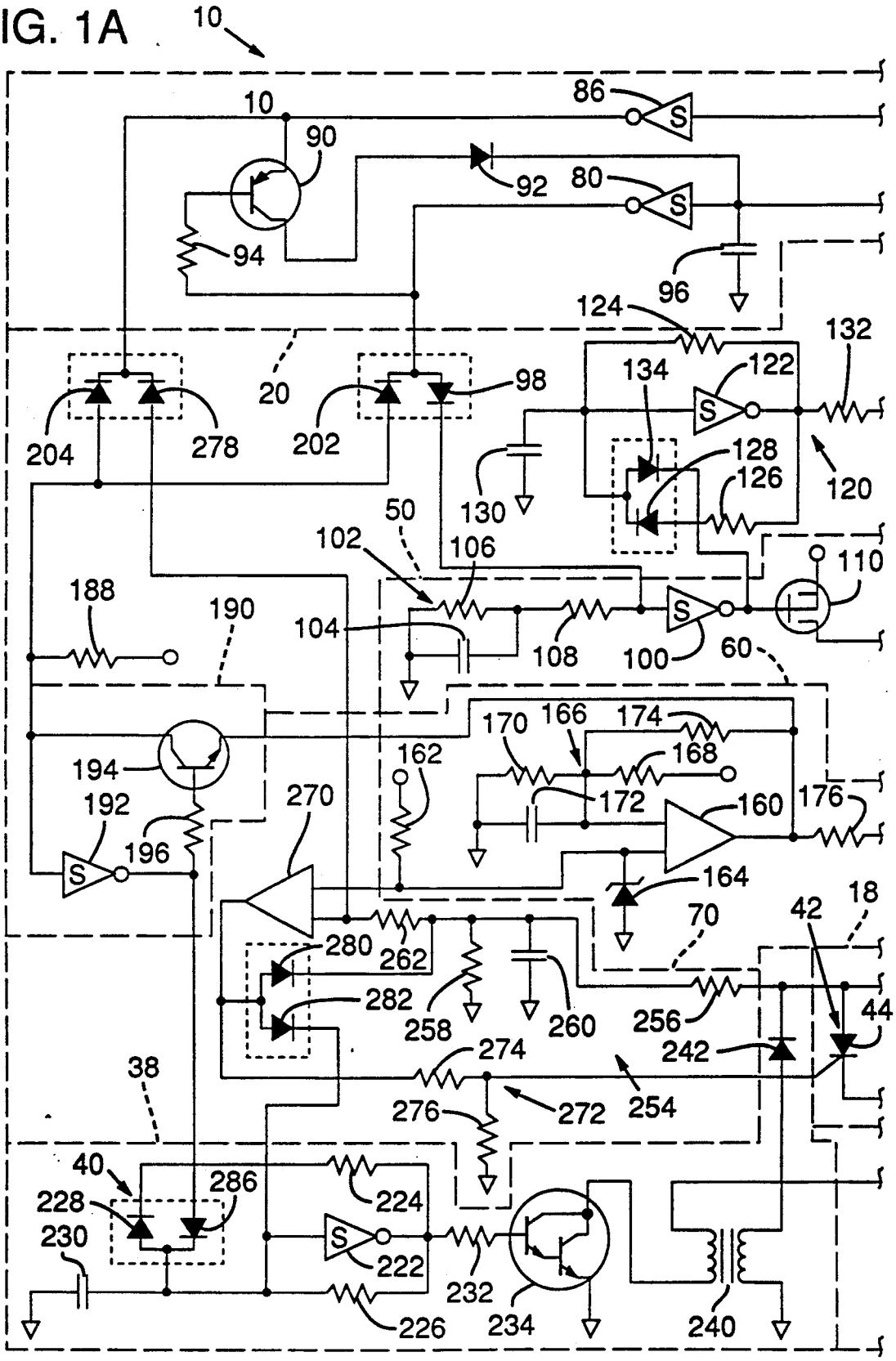
FIGS. 1A and 1B are respective halves of a diagram showing a battery, two normally opened, photoelectric switches, namely a head switch and a trigger switch, and various circuits of an improved ignition system according to a preferred embodiment of this invention.

As shown diagrammatically, an improved, predominantly solid-state ignition system 10 for a combustion-powered tool, such as a combustion-powered nail-driving tool or a combustion-powered, staple-driving tool, constitutes a preferred embodiment of this invention. The ignition system 10 comprises a battery 12, a normally opened, photoelectric, head switch 14, a normally opened, photoelectric, trigger switch 16, a circuit 18 powered by the battery 12 for producing ignition, and a switch-monitoring circuit 20. The switch-monitoring circuit 20 is used for monitoring the head switch 14 and the trigger switch 16. Also, the switch-monitoring circuit 20 is used for enabling the ignition-producing circuit 18 if the trigger switch 16 is closed while the head switch 14 is closed, and for disabling the ignition-producing circuit 18 if the trigger switch 16 is closed while the head switch 14 is opened or if the head switch 14 and the trigger switch 16 are both opened. It is convenient to refer to the battery 12, the head switch 14, and the trigger switch 16 as components of the ignition system 10.

The battery 12 is a rechargeable battery comprising a series of nickel-cadmium cells, having a rated voltage of 6.25 volts, and having a rated current of 1.5 amp-hours. The head switch 14 comprises a phototransmissive diode **14*a*, a photoreceptive transistor 14*b*, and a shutter 14*c* and is regarded as opened when the photoreceptive transistor 14*b* is nonconductive and as closed when the photoreceptive transistor 14*b* is conductive. The trigger switch 16 comprises a phototransmissive diode 16*a*, a photoreceptive transistor 16*b*, and a shutter 16*c* and is regarded as opened when the photoreceptive transistor 16*b* is nonconductive and as closed when the photoreceptive transistor 16*b* is conductive. Essentially, each of these switches 14, 16**, is similar to the photoelectric switch disclosed in the copending application noted above.

The head switch 14 is closed by pressing a workpiece-contacting element, which is mounted operatively to a nosepiece of the tool, firmly against an workpiece. The trigger switch 16 is closed by pulling a trigger, which is mounted operatively to the handle, with the index finger of the same hand. The workpiece-contacting element, the nosepiece, and the handle are not shown.

When each of these switches 14, 16, is closed, the shutter of the switch is moved from a normal position, in which the shutter prevents light from the phototransmissive diode thereof from reaching the photoreceptive transistor thereof, into a displaced position, in which the shutter permits light from the phototransmissive diode to reach the photoreceptive transistor. The shutter is biased toward the normal position. Thus, if there is a failure, such as a severed wire, a failed diode, or a failed transistor, such switch does not become falsely closed.

Generally, the ignition-producing circuit 18 comprises a spark plug 30 having a spark gap 32, a capacitor 36 for producing a spark across the spark gap 32 upon a sudden discharge of the capacitor 36, a circuit 38 comprising a charge-pump oscillator 40 for charging the capacitor 36, and a circuit 42 including a silicon-controlled rectifier 44 for producing a sudden discharge of the capacitor 36. The switch-monitoring circuit 20 is arranged to enable the capacitor-charging circuit 38 if the trigger switch 16 is closed while the head switch 14 is closed and to disable the capacitor-charging circuit 38 if the trigger switch 16 is closed while the head switch 14 is opened or if the head switch 14 and the trigger switch 16 are both opened. Normally, therefore, the switch-monitoring circuit 20 disables the capacitor-charging circuit 38.

Also, the ignition system 10 comprises a fan 48, which is powered by the battery 12, and a fan-controlling circuit 50 for enabling the fan 48 if the head switch 14 is closed and for disabling the fan 48 after a time delay (e.g. ten seconds) upon opening of the head switch 14. The fan 48 is used to produce turbulence in a fuel-air mixture, which can be then ignited by the spark produced across the spark gap 32, in a combustion chamber. Further details of such combustion, as impacted by such turbulence, are found in the Nikolich patents noted above.

Moreover, the ignition system 10 comprises a battery-monitoring circuit 60 for monitoring the battery 12 when the fan 48 is enabled by the fan-enabling circuit 50, for comparing the battery voltage monitored to a reference voltage for the battery 12. The battery-monitoring circuit 60 functions to enable the capacitor-charging circuit 38 if the battery voltage monitored by such circuit 60 is not less than the reference voltage for the battery 12. Also, the battery-monitoring circuit 60 is arranged to disable the capacitor-charging circuit 38 if the battery voltage monitored by such circuit 60 is less than the reference voltage for the battery 12, whereby ignition cannot occur.

Furthermore, the ignition system 10 comprises a capacitor-monitoring circuit 70 for monitoring a capacitor voltage, namely the voltage to which the capacitor 36 is charged by the capacitor-charging circuit 38, and for comparing the capacitor voltage monitored by such circuit 70 to a reference voltage for the capacitor 36. The capacitor-monitoring circuit 70 is arranged to enable the circuit 42 including the silicon-controlled rectifier 44 for producing a sudden discharge of the capacitor 36 if the capacitor voltage monitored by the circuit 70 is not less than the reference voltage for the capacitor 36 and for disabling the same circuit if the capacitor voltage monitored by the circuit 70 is less than the reference voltage for the capacitor 36.

The switch-monitoring circuit 20 does not monitor the head switch 14 and the trigger switch 16 continuously. Rather, the switch-monitoring circuit 20 is arranged for polling the head switch 14 intermittently to determine whether the head switch 14 is closed and for polling the trigger switch 16 intermittently to determine whether the trigger switch 16 is closed, whereby battery energy is conserved.

Figure 1B:
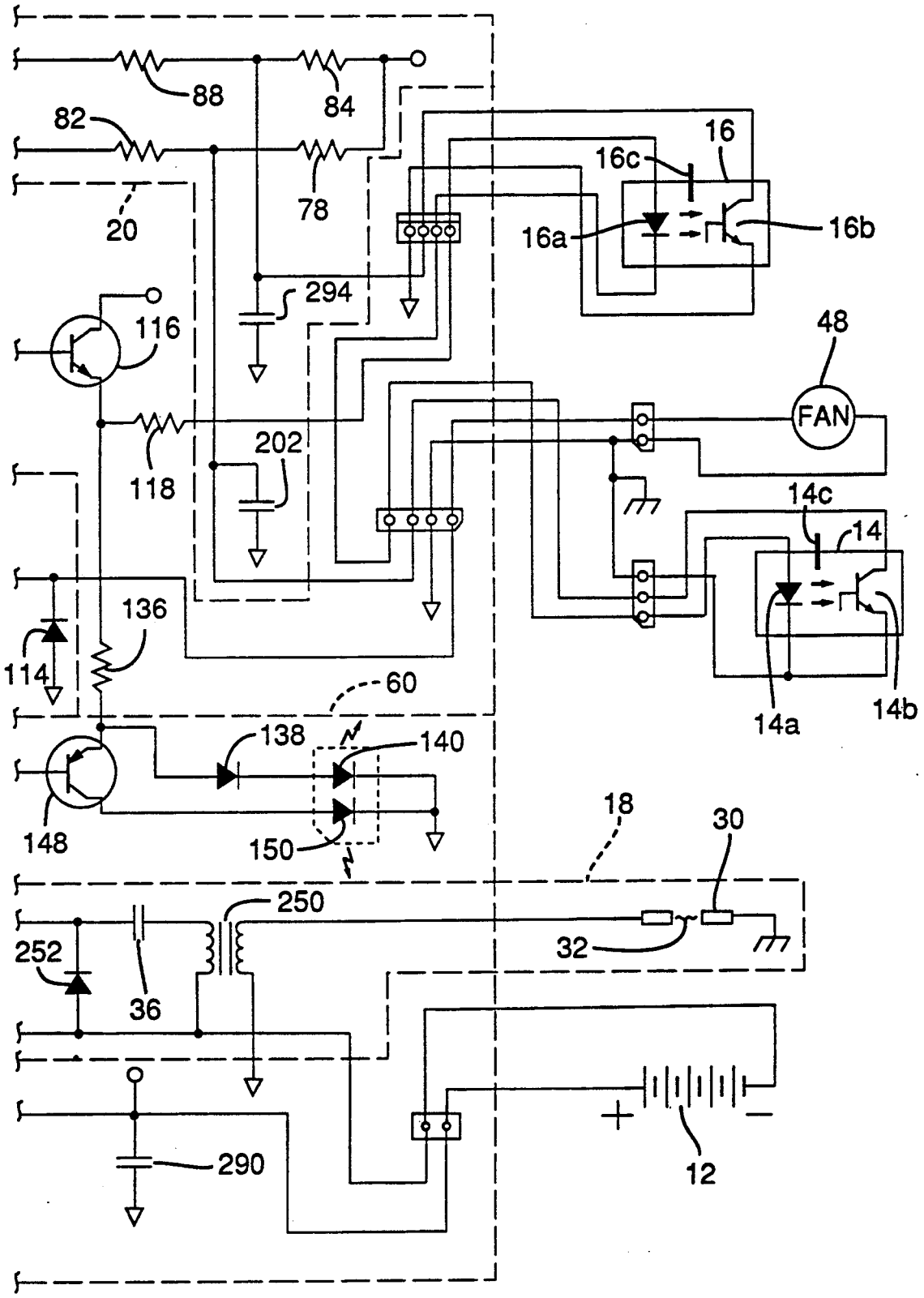

In the switch-monitoring circuit 20, as shown in FIG. 1, the phototransmissive diodes 14*a*, 16*a*, of the respective switches 14, 16, are connected in series between the positive terminal of the battery 12 and ground, via the switch-monitoring circuit 20, so as to be intermittently connected to the positive terminal of the battery 12 as such circuit 20 polls the respective switches 14, 16. The photoreceptive transistor 14*b* of the head switch 14 is connected to the positive terminal of the battery 12, through a resistor 78, and to the input pin of an inverter (Schmitt trigger) 80, through a resistor 82. When the head switch 14 is closed, i.e. when the photoreceptive transistor 14*b* becomes conductive, the input voltage to the inverter 80 drops low and the output voltage from the inverter 80 goes high. The photoreceptive transistor 16*b* of the trigger switch 16 is connected to the positive terminal of the battery, through a resistor 84, and to the input pin of an inverter (Schmitt trigger) 86, through a resistor 88. When the trigger switch 16 is closed, i.e. when the photoreceptive transistor 16*b* becomes conductive, the input voltage to the inverter 86 drops to a low voltage whereupon the output voltage from the inverter 86 rises to a high voltage.

If the output voltage from the inverter 80 is high, the capacitor-charging circuit 38 is enabled. If the output voltage from the inverter 80 is low, the capacitor-charging circuit 38 is disabled. So long as the head switch 14 and the trigger switch 16 are both opened, which means that the photoreceptive transistors 14*b*, 16*b*, are nonconductive, the input voltages to the respective inverters 80, 86, are high and the output voltages from the respective inverters 80, 86, are low.

A transistor 90 is connected between the output pin of the inverter 86 and the input pin of the inverter 80, through a diode 92, which is forward biased when the transistor 90 is switched on. The base of the transistor 90 is connected to the output pin of the inverter 80, through a resistor 94. A capacitor 96 is connected between the input pin of the inverter 80 and the negative terminal of the battery 12.

If the trigger switch 16 is closed while the head switch 14 is opened, i.e. if the photoreceptive transistor 16*b* becomes conductive while the photoreceptive transistor 14*b* is nonconductive, the transistor 90 is switched on to apply a high voltage to the input pin of the inverter 80. Also, if signals indicating that the head switch 14 and the trigger switch 16 are closed are received simultaneously, the delay caused by the capacitor 96 insures that the transistor 90 is switched on and that the transistor 90 applies a high voltage to the input pin of the inverter 80. As a result, the input to the inverter 80 is latched high, and the output from the inverter 80 is low. If the trigger switch 16 is closed while the head switch 14 is closed, i.e. if the photoreceptive transistors 14*b*, 16*b*, become conductive, the transistor 90 is switched off so that no high voltage is applied to the input pin of the inverter 80.

The fan-enabling circuit 50 is connected to the output pin of the inverter 80, via a diode 98, which is connected to the input pin of an inverter (Schmitt trigger) 100. The fan-enabling circuit 50 comprises a timing circuit 102, which comprises a capacitor 104 and a resistor 106 in parallel, and which is connected to the input pin of the inverter 100 via a resistor 108. The output pin of the inverter 100 is connected to the gate of a field-effect transistor 110, which is connected between the positive terminal of the battery 12 and the fan 48. When the field-effect transistor 110 is switched on, the fan 48 is enabled. When the field-effect transistor 110 is switched off, the fan 48 is disabled. When the head switch 14 is closed, i.e. when the output from the inverter 80 goes high, the input to the inverter 100 is high, charges the capacitor 104, and driving the output from the inverter 100 low, whereby the field-effect transistor 110 is switched on. When the head switch 14 is opened, the output voltage from the inverter 80 drops to a low voltage. However, the field-effect transistor 110 remains on while the capacitor 104 discharges through the resistor 106. Thus, the fan 48 remains enabled for a finite time depending upon component values, e.g. ten seconds. A diode 114 connected in parallel with the fan 48 is intended to be normally nonconductive but to break down when the fan 48 is disabled to suppress any potentially damaging voltage spikes induced by the fan 38.

A transistor 116 is connected between the positive terminal of the battery 12 and the series-connected, phototransmissive diodes 14*a*, 16*a*, of the respective switches 14, 16, via a resistor 118, to connect such diodes 14*a*, 16*a*, to the positive terminal of the battery 12 whenever the transistor 116 is switched on. An oscillator 120, which has a conventional configuration, comprises an inverter (Schmitt trigger) 122 and a resistor 124 in parallel, a resistor 126 and a diode 128 in parallel therewith, and a capacitor 130 connecting the input pin of the inverter 122 to the negative terminal of the battery 12.

The output pin of the inverter 122 is connected to the base of the transistor 116 via a resistor 132, so as to switch the transistor 116 on and off intermittently as the oscillator 120 oscillates, thereby to conserve battery energy as the respective switches 14, 16, are polled. The input pin of the inverter 122 is connected to the output pin of the inverter 100 via a diode 134. When the output voltage from the inverter 100 is a low voltage, which switches on the field-effect transistor 110 so as to enable the fan 48, the oscillator 120 is latched via the diode 134 so that the output voltage from the inverter 122 remains high.

The transistor 116 is connected via a resistor 136 and a diode 138 to a green light-emitting diode 140, which flashes intermittently as the transistor 116 is switched on and off intermittently, as an indicator that the ignition system 10 is in a stand-by mode. Also, the green light-emitting diode 140 is lighted steadily when the oscillator 120 is latched so that the output voltage from the inverter 122 remains high, as an indicator that the ignition system 10 is in a ready mode or in a delay mode. A transistor 148 and a red light-emitting diode 150 are connected in parallel with the diode 138 and the green light-emitting diode 140.

The battery-monitoring circuit 60 comprises a comparator (operational amplifier) 160 having a reference pin, an input pin, and an output pin. A resistor 162 is connected between the reference pin of the comparator 160 and the positive terminal of the battery 12. A voltage reference diode 164 is connected between the reference pin of the comparator 160 and the negative terminal of the battery 12. Via the resistor 162 and the voltage reference diode 164, a reference voltage for the battery 12 is applied to the reference pin of the comparator 160. A voltage divider 166 comprising a resistor 168 connected between the positive terminal of the battery 12 and the input pin of the comparator 160, a resistor 170 and a capacitor 172 connected in parallel between the input pin of the comparator 160, and a resistor 174 connected between the input and output pins of the comparator 160 applies a voltage proportional to the battery voltage to the input pin of the comparator 160. The resistor 170 and the capacitor 172 protect the comparator 160 against false signals due to radio frequency interference or electrical noise.

If the voltage applied to the input pin of the comparator 160 is not less than the reference voltage for the battery 12, the voltage at the output pin of the comparator 160 is high. If the voltage applied thereto is less than the reference voltage for the battery 12, the voltage at the output pin of the comparator 160 is low. The voltage at the output pin of the comparator 160 is applied via a resistor 176 to the base of the transistor 148. If the voltage applied to the base of the transistor 148 is low, the transistor 148 is switched on, so as to create a short circuit across the diode 138 and the green light-emitting diode 140, and so as to light the red light-emitting diode 150 steadily, as an indicator that the battery voltage is inadequate. If the output voltage applied thereto is a high voltage, the transistor 148 is not switched on, and the green light-emitting diode 140 can be then lighted.

The capacitor-charging circuit 38 is connected to the positive terminal of the battery 12 via a resistor 188 and a latching circuit 190. The latching circuit 190 comprises an inverter (Schmitt trigger) 192 having its input pin connected to the resistor 188, a transistor 194 connected to the input pin of the inverter 192, and a resistor 196 connected between the output pin of the inverter 192 and the base of the transistor 194. The transistor 194 is connected to the output pin of the comparator 160.

Normally, the output voltage from the inverter 192 is a high voltage, which switches on the transistor 194. When the output voltage from the comparator 160 is a low voltage, which means that the battery voltage is insufficient, the transistor 194 remains switched on to disable the capacitor-charging circuit 38. As long as the output voltage from the comparator 160 is a low voltage, the latching circuit 190 is latched on and continues to disable the capacitor-charging circuit 38 until the output of the comparator 160 is a high voltage, which means that the battery voltage is sufficient for proper operation.

The resistor 188 and the input pin of the inverter 192 are connected to the output pin of the inverter 80, via a diode 202, and to the output pin of the inverter 86, via a diode 204. When the output voltages from the inverters 80, 86, are low, the voltage applied to the input pin of the inverter 192 is insufficient to cause the inverter 192 to invert. Also, when the transistor 194 is conducting, the voltage applied to the input pin of the inverter 192 is insufficient to cause the inverter 192 to invert. Otherwise, when the output voltages from the inverters 80, 86, are high because the respective switches 14, 16, have been closed in their proper sequence, a high voltage is applied to the input pin of the inverter 192. Thus, the inverter 192 exhibits a low voltage from its output pin. Via the resistor 196, the low voltage from the output pin of the inverter 192 is applied to the base of the transistor 194, which is switched off, which means that the latching circuit 190 is off. At this time, even if the battery voltage drops transiently below the reference voltage for the battery 12 when the capacitor-charging circuit 38 is operating, the latching circuit 190 does not disable the capacitor-charging circuit 38.

Via a diode 286, the output pin of the inverter 192 is connected to the charge-pump oscillator 40 of the capacitor-charging circuit 38. The charge-pump oscillator 40, which has a conventional configuration, comprises an inverter (Schmitt trigger) 222 and a resistor 226 in parallel, a resistor 224 and a diode 228 in parallel therewith, and a capacitor 230 connecting the input pin of the inverter 222 to the negative terminal of the battery 12. The output voltage from the output pin of the inverter 222 is connected via a resistor 232 to the base of a Darlington transistor 234, which is connected in series with the primary winding of a step-up transformer 240. The primary winding of the transformer 240 is connected to the positive terminal of the battery 12. The secondary winding of the transformer 240 is connected via a diode 242 to the capacitor 36. Thus, as the charge-pump oscillator oscillates, the capacitor 36 is charged stepwise.

The capacitor 36 is connected in series with the primary winding of an output transformer 250. A diode 252 connected in parallel with the capacitor 36 and the primary winding of the transformer 250 is intended to be normally nonconductive but to break down so as to increase the spark duration in a manner explained below. The secondary winding of the transformer 250 is connected to one electrode of the spark plug 30. The other electrode of the spark plug 30 is grounded. Thus, upon a sudden discharge of the capacitor 36, a spark is produced at the spark gap 32 of the spark plug 30. The silicon-controlled rectifier 44 is connected in parallel with the capacitor 36 and the primary winding of the transformer 250, and in parallel with the diode 252, so as to produce a sudden discharge of the capacitor 36 through the primary winding of the transformer 250 when the silicon-controlled rectifier 44 is switched on. After the initial, sudden discharge, reverse induced current is allowed to flow through the primary of the transformer 250 via the diode 252, which recharges the capacitor 36. This charge/discharge/recharge oscillation between the primary of the transformer 250 and the capacitor 36 greatly increases the spark duration time.

In the capacitor-monitoring circuit 70, a voltage divider 254 comprising a resistor 256 connected to the capacitor 36, a resistor 258 and a capacitor 260 connected in parallel between the resistor 256 and the negative terminal of the battery 12, and a resistor 262 applies a voltage proportional to the voltage to which the capacitor 36 has been charged to the input pin of a comparator (operational amplifier) 270. The resistor 162 noted above in a context of the comparator 160 is connected between the reference pin of the comparator 270 and the positive terminal of the battery 12. The voltage reference diode 164 noted above in the same context is connected between the reference pin of the comparator 270 and the negative terminal of the battery 12. Via the resistor 162 and the voltage reference diode 164, a reference voltage for the capacitor 36 is applied to the reference pin of the comparator 270. Because the resistor 162 and the voltage reference diode 164 define the reference voltage for the capacitor 36 as well as the reference voltage for the battery 12, the reference voltages therefor are equal. If the voltage applied to the input pin of the comparator 270 is not less than the reference voltage for the capacitor 36, the output voltage from the output pin of the comparator 270 is high. If the voltage applied to the input pin of the comparator 270 is less than the reference voltage for the capacitor 36, the output voltage from the output pin of the comparator 270 is low.

The output voltage from the comparator 270 is applied via a voltage divider 272, which comprises a resistor 274 connected to the output pin thereof and a resistor 276 connected between the resistor 274 and the negative terminal of the battery 12, to the gate of the silicon-controlled rectifier 44. If a high voltage is applied to the gate thereof, the silicon-controlled rectifier 44 is switched on, so as to produce a sudden discharge of the capacitor 36 through the primary winding of the output transformer 250.

The input pin of the comparator 270 is connected via a diode 278 to the output pin of the inverter 86. If the trigger switch 16 is opened before the capacitor 36 is discharged through the primary winding of the output transformer 250, the voltage at the output pin of the inverter 86 drops to a low voltage, so as to discharge the capacitor 36 through the diode 278.

A high voltage from the output pin of the comparator 270 is applied, via a diode 280 and the resistor 262, to the input pin of the comparator 270 so as to latch the output of the comparator 270 high. The same voltage is applied, via a diode 282, to the input pin of the inverter 222 so as to latch the output of the inverter 222 low. A new cycle of the ignition system 10 cannot be then initiated until the trigger switch 16 has been opened.

So as stabilize the circuits and to minimize susceptibility to false triggering stimuli from outside sources, such as radio frequency interference and electrical noise, a capacitor 290 is connected across the battery 12. Moreover, a capacitor 292 is associated with the resistor 82, so as to protect the inverter 80, and a capacitor 294 is associated with the resistor 88, so as to protect the inverter 86.

The green light-emitting diode 140 and the red light-emitting diode 150 function as mode indicators. When the green light-emitting diode 140 is flashing, the ignition system 10 is in a low current consumption, standby mode, in which the battery voltage monitored by the battery-monitoring circuit 60 is not less than the reference voltage for the battery 12 and in which the head switch 14 and the trigger switch 16 are both opened. When the green light-emitting diode 140 is lighted steadily, the ignition system 10 is in a ready mode, in which the head switch 14 has been closed and in which the fan 48 has been enabled, or in a delay mode, in which the head switch 14 has been opened and in which the fan 48 remains enabled for the time delay (e.g. ten seconds) discussed above. After the time delay, the ignition system 10 leaves the delay mode and reenters the standby mode. Also, the ignition system 10 has an ignition mode, which it enters from the ready mode when the trigger switch 16 is closed and which it leaves when the trigger switch 16 is opened.

Various modifications may be made in the preferred embodiment described above without departing from the scope and spirit of this invention.

We claim:

1. For a combustion-powered tool, an ignition system comprising a battery, two normally opened switches connected to the battery, namely a head switch and a trigger switch, means powered by the battery for producing ignition, and switch-monitoring means for monitoring the head and trigger switches, for enabling the ignition-producing means if the trigger switch is closed while the head switch is closed, and for disabling the ignition-producing means if the trigger switch is closed while the head switch is opened or if both switches are opened.

2. The ignition system of claim 1 wherein the ignition-producing means comprises a spark plug having a spark gap, means comprising a capacitor for producing a spark across the spark gap upon a sudden discharge of the capacitor, means powered by the battery for charging the capacitor, and means for producing a sudden discharge of the capacitor, the switch-monitoring means being arranged to enable the capacitor-charging means if the trigger switch is closed while the head switch is closed and to disable the capacitor-charging means if the trigger switch is closed while the head switch is opened or if both switches are opened.

3. The ignition system of claim 1 wherein the ignition-producing means comprises a spark plug having a spark gap, means comprising a capacitor for producing a spark across the spark gap upon a sudden discharge of the capacitor, means powered by the battery for charging the capacitor, means for producing a sudden discharge of the capacitor, and battery-monitoring means for monitoring the battery voltage, for comparing the battery voltage monitored thereby to a reference voltage for the battery, for enabling the capacitor-charging means if the battery voltage monitored thereby is not less than the reference voltage for the battery, and for disabling the capacitor-charging means if the battery voltage monitored thereby is less than the reference voltage for the battery.

4. The ignition system of claim 3 comprising a fan powered by the battery and means for enabling the fan if the head switch is closed, the battery-monitoring means being arranged to monitor the battery voltage when the fan is enabled.

5. The ignition system of claim 3 comprising a fan powered by the battery and means for enabling the fan if the head switch is closed and for disabling the fan after a time delay upon opening of the head switch, the battery-monitoring means being arranged to monitor the battery voltage when the fan is enabled.

6. The ignition system of claim 2 wherein the ignition-producing means comprises capacitor-monitoring means for monitoring the capacitor voltage, for comparing the capacitor voltage to a reference voltage for the capacitor, for enabling the means for producing a sudden discharge of the capacitor if the capacitor voltage monitored thereby is not less than the reference voltage for the capacitor, and for disabling the means for producing a sudden discharge of the capacitor if the capacitor voltage monitored thereby is less than the reference voltage for the capacitor.

7. The ignition system of claim 2 wherein the ignition-producing means comprises battery-monitoring means for monitoring the battery voltage, for comparing the battery voltage monitored thereby to a reference voltage for the battery, for enabling the capacitor-charging means if the battery voltage monitored thereby is not less than the reference voltage for the battery, and for disabling the capacitor-charging means if the battery voltage monitored thereby is less than the reference voltage for the battery.

8. The ignition system of claim 7 comprising a fan powered by the battery and means for enabling the fan if the head switch is closed, the battery-monitoring means being arranged to monitor the battery voltage when the fan is enabled.

9. The ignition system of claim 7 comprising a fan powered by the battery and means for enabling the fan if the head switch is closed and for disabling the fan after a time delay upon opening of the head switch, the battery-monitoring means being arranged to monitor the battery voltage when the fan is enabled.

10. The ignition system of claim 9 wherein the ignition-producing means comprises capacitor-monitoring means for monitoring the capacitor voltage, for comparing the capacitor voltage to a reference voltage for the capacitor, for enabling the means for producing a sudden discharge of the capacitor if the capacitor voltage monitored thereby is not less than the reference voltage for the capacitor, and for disabling the means for producing a sudden discharge of the capacitor if the capacitor voltage monitored thereby is less than the reference voltage for the capacitor.

11. The ignition system of claim 1 wherein the switch-monitoring means comprises means for polling the head switch intermittently to determine whether the head switch is closed and for polling the trigger switch intermittently to determine whether the trigger switch is closed.

12. The ignition system of claim 10 wherein the switch-monitoring means comprises means for polling the head switch intermittently to determine whether the head switch is closed and for polling the trigger switch intermittently to determine whether the trigger switch is closed.

13. The ignition system of claim 1 wherein each of the head and trigger switches is a photoelectric switch comprising a phototransmissive element and a photoreceptive element and being regarded as opened when the photoreceptive element is nonconductive and as closed when the photoreceptive element is conductive.

14. The ignition system of claim 12 wherein each of the head and trigger switches is a photoelectric switch comprising a phototransmissive element and a photoreceptive element and being regarded as opened when the photoreceptive element is nonconductive and as closed when the photoreceptive element is conductive.

* * * * *